United States Patent [19]

Ohyama

[11] Patent Number: 4,616,966

[45] Date of Patent: Oct. 14, 1986

[54] METHOD FOR CHAMFERING

[75] Inventor: Iwane Ohyama, Kamakura, Japan

[73] Assignee: Tokyo Shibaura Denki Kabushiki Kaisha, Kawasaki, Japan

[21] Appl. No.: 540,686

[22] Filed: Oct. 11, 1983

Related U.S. Application Data

[63] Continuation-in-part of Ser. No. 370,101, Apr. 20, 1982, abandoned, which is a continuation of Ser. No. 163,477, Jun. 27, 1980, abandoned.

[30] Foreign Application Priority Data

Jul. 3, 1979 [JP] Japan ..... 54-83465
Apr. 30, 1980 [JP] Japan ..... 55-57504

[51] Int. Cl.[4] ..... B23C 3/12

[52] U.S. Cl. ..... 409/132; 409/138; 83/432; 83/869

[58] Field of Search ..... 409/132, 138, 301, 303; 83/432, 496, 497, 495, 869, 581, 676; 407/7

[56] References Cited

U.S. PATENT DOCUMENTS

| | | | |
|---|---|---|---|
| 870,301 | 11/1907 | Lingenfelter | 83/496 |
| 2,003,049 | 5/1935 | Hull | 83/432 |
| 2,381,807 | 8/1945 | Davis et al. | 83/432 |
| 2,381,808 | 8/1945 | Davis et al. | 83/869 |
| 2,690,804 | 10/1954 | Erlert | 83/432 |
| 2,908,203 | 10/1959 | Persson | 409/303 |
| 3,377,896 | 4/1968 | De Corta | 83/432 |

FOREIGN PATENT DOCUMENTS 2758014 7/1979 Fed. Rep. of Germany .

*Primary Examiner*—Gil Weidenfeld
*Assistant Examiner*—Daniel W. Howell
*Attorney, Agent, or Firm*—Cushman, Darby & Cushman

[57] ABSTRACT

A method for chamfering an edge of a silicon steel plate moving in the longitudinal direction of the edge by applying an entirely circular edge tip of a ring-shaped cutting edge portion of a circular cutter to the edge of the plate material while rotating the circular cutter. The edge tip of the cutting edge portion of the cutter has a rake angle which is within the range of 0 to −1.0 degrees and a relief angle which has a zero or positive value.

2 Claims, 10 Drawing Figures

METHOD FOR CHAMFERING

RELATED APPLICATIONS

This is a continuation-in-part of application Ser. No. 370,101, filed on Apr. 20, 1982 (abandoned after the filing of this application) which was a continuation of application Ser. No. 163,477 (abandoned) filed June 27, 1980.

BACKGROUND OF THE INVENTION

This invention relates in general to the art of chamfering an edge of plate-like material. More specifically the invention provides a method for chamfering an edge of a plate material or plate-like workpiece which is continuously fed in the longitudinal direction of the edge. The chamfering is carried out using a circular cutter having a circular cutting edge portion protruding from the periphery of a holder on one side of the cutter which is driven to rotate.

A similar method for chamfering an edge of a workpiece will now be described. A circular cutter is tilted relative to the longitudinal direction of the workpiece so that its circular cutting edge portion may chamfer an edge of a workpiece only on one side of the circular cutting edge portion. The rotating direction of cutting edge portion is determined in accordance with the feeding direction of the workpiece.

This known method is effective in chamfering many kinds of workpieces. However, it is not effective in chamfering a very thin plate such as a silicon steel plate used, for example, in an electric machine. First, the circular edge tip of the circular cutting edge portion are not properly shaped so as to define advantageous rake and relief angles. If it is not properly shaped, the desired chamfering is impossible. Secondly, when a moving workpiece, which has been chamfered in the known manner, is stopped for cutting and then moved again, the circular edge tip is liable to excessively bite into an edge of the workpiece. As a result, chamfered portions may not be uniform, unlike the case where chamfering is performed continuously.

SUMMARY OF THE INVENTION

A primary object of the invention is to provide a method for chamfering a thin plate, particularly a silicon steel plate, which method is free from the above defects attendant the known method and which is capable of chamfering the plate without causing the edge tip of a cutter to bite into the plate (if this biting is severe enough, a silicon steel plate may crack) and without causing the edge tip to bite into or cut excessively the plate edge to be chamfered even if the feeding speed of the plate changes or if the moving plate is stopped and then moved again.

Various experiments were conducted using a silicon steel plate workpiece and circular cutters having edge tips of various shapes. As a result, it was determined that the rake angle of an edge tip should be within the range of 0 to −1.0 degrees and the relief angle thereof should have a zero value or a positive value so as to perform smooth and uniform chamfering, and to prevent the edge tip of the cutter from biting into the plate to be chamfered regardless of a change in the feeding speed of the plate. It was also determined how the circular cutter should be postured and in which direction it should be rotated relative to a silicon steel plate to be chamfered. The details of these points will be discussed in further detail with reference to the figures.

According to the chamfering method of this invention, sound edge portions free from any flaws can be chamfered with substantially uniform dimensions without causing a chamfering tool to be caught by local dents, curves or other flaws that exist or to bite into a plate material, especially a thin one. This is possible because the edge of the silicon steel plate or plate material is rounded off by the rotating edge tip, which is an integral protrusion or circular ring having no indentations. Since the chamfering is performed on one side only of the circular ring-shaped edge tip by slanting the cutter relative to the plate material edge to be chamfered, secondary burrs will rarely occur, and noises produced during the chamfering are minimized. Further, since the edge tip of the cutter is ring-shaped, the thermal capacity of the cutter is large, and hence a rise in the edge tip temperature which may be caused during the chamfering process is reduced as compared with the case of the prior art cutter.

Furthermore, according to this invention, the circular cutter is provided with a circular edge tip, rake and relief angles which are within predetermined ranges as described above. Therefore, the edge tip is prevented from biting into the plate material to be chamfered even if the plate material feeding speed changes or if the moving plate material is stopped and then moved again. In this manner, smooth and uniform chamfering is possible at any time.

DETAILED DESCRIPTION OF THE PREFERRED EMBODIMENTS

Figure 1:
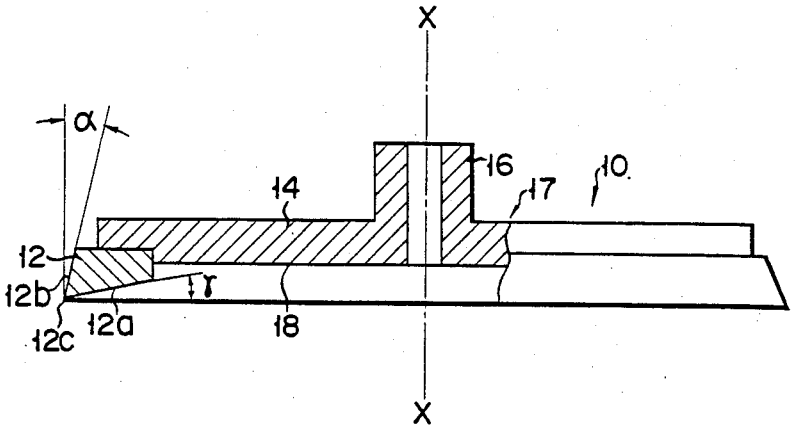
FIG. 1 is a partial profile of a circular cutter used for the method of chamfering according to this invention.

Referring now to FIG. 1, there is shown a circular cutter 10 used in the method of this invention. Circular cutter 10 includes a circular ring-shaped cutting edge portion 12 and a holder 17. Holder 17 includes a disc portion 14 fitted with cutting edge portion 12 and a hub 16 protruding from disc portion 14 and intended to be coupled to the output shaft of a driving mechanism such as a motor. Cutting edge portion 12 is firmly attached to a main face 18 of disc portion 14 to face a plate material such as, for example, a silicon steel plate 20 (FIG. 5) by brazing, screwing or bonding. Formed of cemented carbide, cutting edge portion 12 protrudes outward from the main face 18 and disc portion 14. A section taken along the central axis X—X of the cutting edge portion 12 is as shown in FIGS. 1, 2 and 3 in which there are shown a flank 12*a*, a rake face 12*b*, an edge tip 12*c* of cutting edge portion 12 in the form of a circle (hereinafter referred to as edge tip circle) around an axis line X—X, a rake angle $\alpha$ formed between the rake face 12*b* and the direction X—X, and a relief angle $\gamma$ formed between main face 18 and flank 12*a*.

Figure 2:
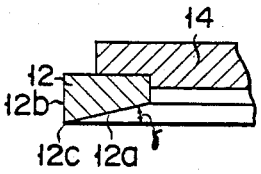
FIGS. 2 and 3 are profiles showing alternate embodiments of the cutting edge portion of the cutter shown in FIG. 1.
Figure 3:
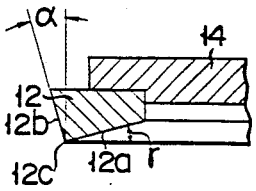

FIGS. 2 and 3 are sectional views of cutting edge portions similar to the section of FIG. 1, showing alternative embodiments of the sectional shape of FIG. 1. The sectional shape may suitably be selected according to several working conditions including the material of workpiece, working speed, chamfer dimensions, etc.

Figure 4:
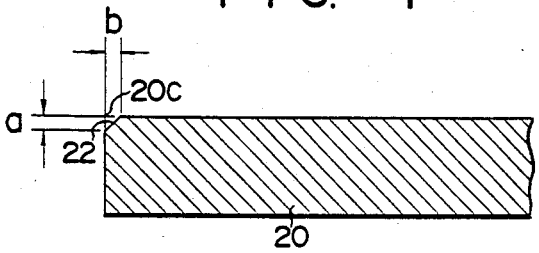
FIG. 4 illustrates the chamfer dimensions of an edge of a plate material workpiece.

FIG. 4 is a diagram illustrating the chamfer dimensions. In this drawing, numeral 20 designates a plate material as a workpiece which is represented in section at right angles to its longitudinal direction. Symbols a and b, which represent the chamfer dimensions as they are called herein, may designate values ranging e.g. from 0.01 mm to 0.5 mm for a silicon steel plate.

Figure 5:
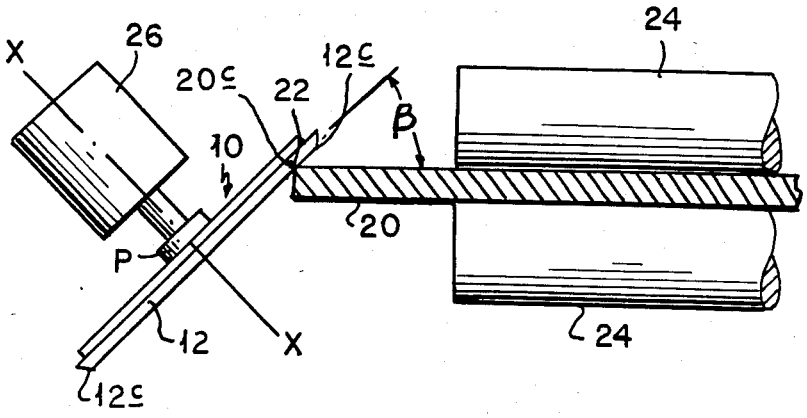
FIG. 5 is a front view showing an example of a method, according to the invention, for chamfering an edge of a plate material workpiece by using any one of the circular cutters of FIGS. 1 to 3.

FIG. 5 shows a method for chamfering one edge 20*c* of the plate material 20 by using the circular cutter 10. Numeral 22 designates a portion to be removed by such chamfering. In FIG. 5, the plate material 20 is fed at right angles to the plane of the drawing by means of a feed roller 24.

By way of example, the plate material 20 may be one which is drawn out from a silicon steel plate coil. Circular cutter 10 is driven by a motor 26 to rotate. Although coupled directly to the output shaft of motor 26 in FIG. 5, circular cutter 10 may otherwise be connected to the motor 26 by means of a suitable speed change gear mechanism. In chamfering the edge 20*c* of the plate material 20, the circular cutter 10 is so located that its working face is defined by the edge 20*c* and is at an angle of $\beta$ to the top surface of the plate material 20. The angle $\beta$ is usually smaller than 45°, preferably within a range of 30°±5°. Circular cutter 10 is pressed against edge 20*c* while being kept in the aforesaid posture, and is fixed to a desired cutting position for chamfering. Edge 20*c* of the plate material 20 runs along the chord of the edge tip circle so as to be chamfered to desired dimensions at both end portions of the chord. In actual chamfering of the plate material 20, two circular cutters 10 are disposed respectively on both sides of plate material 20 so that the edges on the same side (top or bottom side) of the plate material 20 may be chamfered at the same time.

Figure 6:
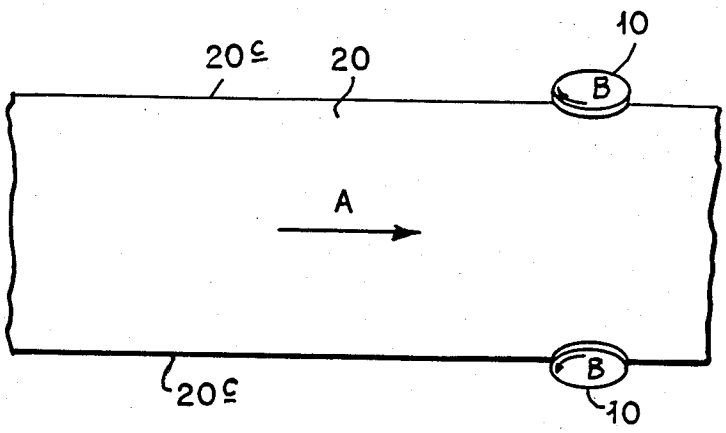
FIG. 6 is an explanatory plan view showing an arrangement of circular cutters with reference to a moving workpiece and indicating the direction of rotation of the cutters.

FIG. 6 is a plan view showing the positional relationship between the two circular cutters 10 (each represented by a mere disc to more simply show the overall arrangement only) and the plate material 20. Plate material 20 is fed toward circular cutters 10 after it is worked by a well-known roller-type stretching device (not shown) so as to be substantially flattened. Then, plate material 20 is moved in the direction of an arrow A, and each circular cutter 10 is rotated in the direction of an arrow B. Thus, plate material 20 moves substantially oppositely to the moving direction of the edge tip 12*c* at each portion subjected to chamfering. Further, the rotating speed of the circular cutter 10 is preferably so selected that the circumferential speed of the edge tip 12*c* is approximately (25±10)% of the running speed of the plate material 20.

If the plate material 20 is a sheet metal, or if dents, bends or other flaws are scattered on edge 20*c*, portions free from such flaws may be chamfered with the given dimensions, according to the method for chamfering the plate material 20 described in connection with the drawings of FIGS. 5 and 6. This is achieved since the chamfering is performed by means of the circular cutter 10, the circular edge tip 12*c* can perfectly continuously cover every portion of the moving edge 20*c*, unlike one or more independently protruding edge tips of a conventional cutter. Accordingly, even if part of the edge 20*c* is subject to scattered flaws, edge tip 12*c* will never bite into the flaws or the plate material 20. Moreover, if edge 20*c* is moved in a fixed direction at a fixed position and if the circular cutter 10 is fixed to a preadjusted position, sound portions free from the flaws may be chamfered with substantially uniform dimensions. Thus, since the chamfering may be achieved by cutting without bite of the edge tip 12*c*, noises produced during the processing are reduced as compared with the case of grinder processing, and there will never be caused any secondary flashes or danger due to separation of abrasive grains. Further, the cutting edge portion 12 of the circular cutter 10 is solidly formed in the shape of a ring, so that the thermal capacity of the cutter 10 is large. Accordingly, a temperature rise which may be caused at the cutting edge portion 12 during the chamfering process is relatively small, and the circular cutter 10 will be able to enjoy prolonged life.

Although FIGS. 5 and 6 show a case where top-side edges of the plate material 20 on both sides are chamfered, it is to be understood that the bottom-side edges may also be chamfered with the circular cutter 10 located on the under side of the plate material 20.

According to this invention, the cutting edge portion 12 is so shaped as to have a rake angle $\alpha$ which is within the range of 0 to −1.0 degrees and a relief angle $\gamma$ which has a zero or positive value. An example of the rake angle $\alpha$ is shown in FIG. 1. In this figure, rake face 12*b* is tilted in the counterclockwise direction degrees relative to the central axis X—X of cutting edge portion 12. An angle tilted in the counterclockwise direction is represented by a negative number. In FIG. 1, the relief angle $\gamma$ has a zero value. In FIG. 2, the rake angle $\alpha$ and relief angle $\gamma$ have a zero value and a positive value, respectively. Flank 12*a* of the cutting edge portion 12 shown in FIGS. 2 or 3 defines a triangular space between itself and the main surface 18. Such an inclination of the flank 12*a* is represented by a positive number. In the cutting edge portion 12 shown in FIG. 3, the rake angle $\alpha$ is within the range of 0 to −1.0 degree and the relief angle $\gamma$ has a positive value.

Figure 7:
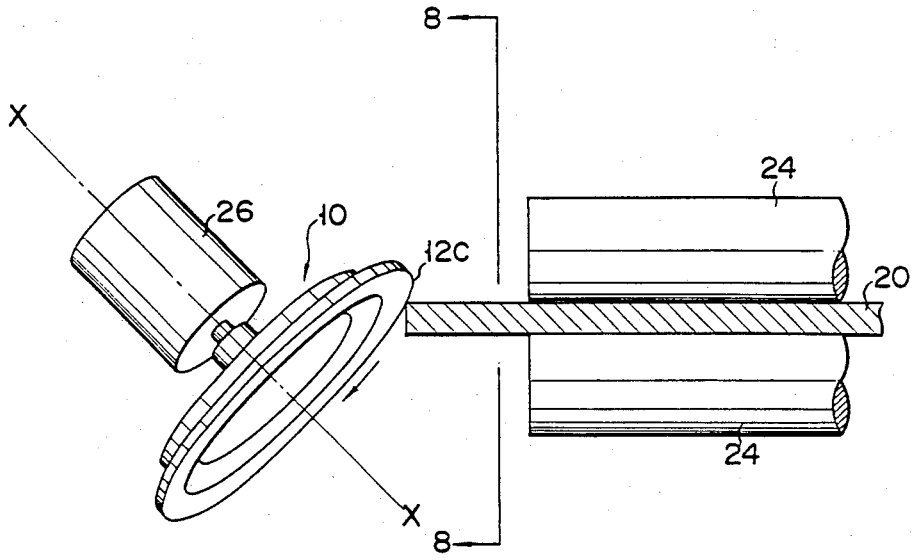
FIG. 7 is a front view showing another example of a method, according to the invention, for chamfering an edge of a plate material workpiece.

FIG. 7 shows a second embodiment of the method for chamfering of this invention. In this case, motor 26 and circular cutter 10 are slightly tilted as compared with the position of FIG. 5. Such tilt can be obtained by slightly turning the line X—X around a suitably selected point on the line X—X, e.g. point P of FIG. 5, within a plane including the line X—X and extending at right angles to the drawing of FIG. 5. FIG. 7 shows a position of circular cutter 10 which has been adjusted for transverse location for proper chamfering by slightly turning the line X—X in the aforesaid manner. The tilt shown in FIG. 7, however, is exaggerated for more clear illustration.

Figure 8:
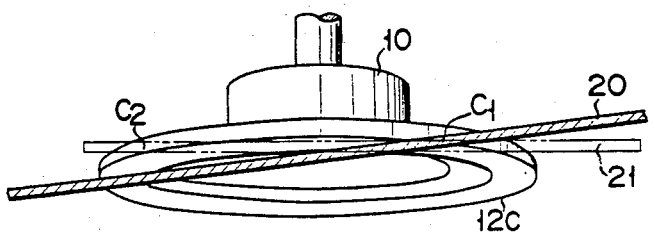
FIG. 8 is a diagram for illustrating the difference between the chamfering methods of FIGS. 5 and 7.

FIG. 8 shows the relative positions of circular cutter 10 and plate material 20 of FIGS. 5 and 7. In this drawing, plate material 10 is shown, for clearness, as if it is moved relatively to the circular cutter 10 which is fixed. FIG. 8 is a view as taken along line 8—8 of FIG. 7, in which plate material 20, represented by full line, is chamfered at a single point indicated by $C_1$. The positional relationship between the circular cutter 10 and the plate material represented by chain line and denoted by reference numeral 21 corresponds to the FIG. 5 arrangement. In this case, plate material 21 is worked by the circular cutter 10 at two points indicated by $C_1$ and $C_2$. According to the method for chamfering shown in FIG. 8, the location of circular cutter 10 relative to plate material 20 is facilitated, so that burrs which may be formed on chamfers due to small errors or variations in the location can be reduced.

When an edge of the plate material 20 is chamfered by using the circular cutter 10 having the cutting edge portion 12 shown in FIGS. 1, 2 or 3, by posturing the circular cutter 10 as shown in FIGS. 7 or 8 and by rotating it in the direction shown in the arrow in FIGS. 7 or 8, the edge can be chamfered uniformly and smoothly at any time. That is, edge tip 12*c* of the cutting edge portion 12 is prevented from biting into the plate material 20 even when the plate material 20 is fed substantially at the same speed to perform successive chamfering or even when the movement of the plate material 20 changes in speed or when the moving plate material is stopped and then moved again.

Figure 9:
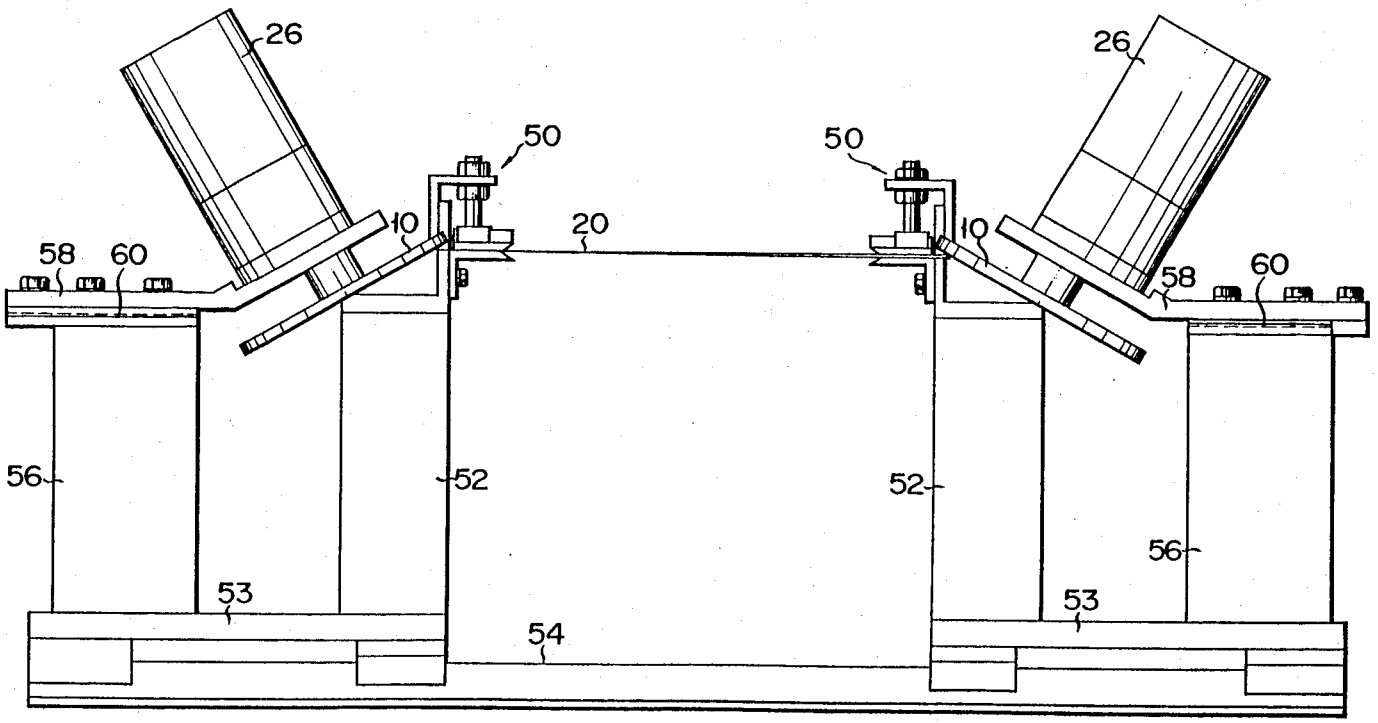
FIG. 9 is a front view of a plate material chamfering apparatus using circular cutters.

FIG. 9 is a front view for illustrating the arrangements of principal mechanisms of an apparatus for chamfering both edges of the plate material 20 on the top side. Guided by plate material guide members 50, plate material 20 is fed in the direction at right angle to the drawing of FIG. 9. Each plate material guide member 50 is attached to a first frame 52 which is mounted on a guide rail 54 through a truck 53. Mounted on the truck 53 is a second frame 56 on which the motor 26 and the circular cutter 10 are fixed by means of an arm 58. The truck 53 bearing the first and second frames 52 and 56 is adjusted for transverse location on the guide rail 54 as in FIG. 9 so that the plate material guide member 50 and the circular cutter 10 may guide the plate material 20 at proper positions relative to the plate material 20, thereby enabling the circular cutter 10 to chamfer the plate material 20 at a proper position.

A member 60 interposed between arm 58 and second frame 56 of FIG. 9 is an angle regulating member which tilts the motor 26 and circular cutter 10 by utilizing the action of wedge so that the circular cutter 10 may perform chamfering at one point as shown in FIGS. 7 and 8.

Figure 10:
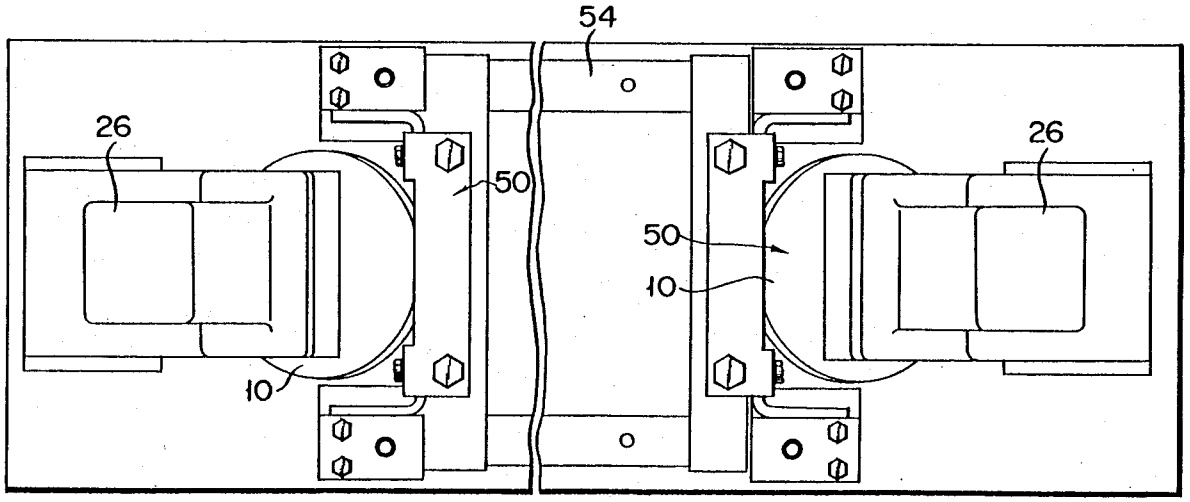
FIG. 10 is a plan view of the apparatus of FIG. 9.

FIG. 10 is a plan view of the apparatus of FIG. 9, in which each circular cutter 10 in a tilted position is drawn in the shape of an oval. In this drawing, plate material 20 is not on the apparatus.

While the invention has been described in connection with what is presently considered to be the most practical and preferred embodiments, it is to be understood that the invention is not to be limited to the disclosed embodiments but on the contrary, is intended to cover various modifications and equivalent arrangements included within the spirit and scope of the appended claims which scope is to be accorded the broadest interpretation so as to encompass all such modifications and equivalent structures.

I claim:

1. A method of chamfering an edge of a plate-like workpiece, especially a workpiece made of a silicon steel plate, comprising the steps of:

providing a rotating circular cutter having a ring-shaped cutting edge portion formed along a periphery of a holder therefor, the cutting edge portion having an edge tip defining a circle, said edge tip having a rake angle within the range of 0 to −1.0 degrees and a relief angle whch has a zero or positive value;

orienting the cutter to the workpiece so that the edge of the workpiece to be chamfered engages the edge tip at only one portion of the circle as the workpiece moves with respect to the cutter to engage various portions of the edge to be chamfered, this step of orienting including establishing positional relationships such that:

(a) the angle formed between an upper surface of the workpiece and a working plane of the cutter, which plane includes a circle defined by the edge top of the cutting edge portion of the cutter, falls within the range of 0° to 45°, (b) the plane including the upper surface of the workpiece crosses at two points with said circle defined by the edge top of the cutting edge portion of the cutter, (c) the working plane of the cutter is inclined relative to the edge of the workpiece to be chamfered such that the working plane crosses with the edge of the workpiece at only the front portion of the cutter working plane in a moving direction of the workpiece so as to allow the edge of the workpiece to be chamfered only at the single cross point thereby formed, and (d) rotation of the circular cutter is permitted such that, for a projection of the cutter onto the upper surface of the workpiece, the edge tip of the cutting edge portion of the cutter is moved at the cross point from an overlapping region between the projection of the cutting and the workpiece to a non-overlapping region thereof;

rotating the cutter; and moving the workpiece in a direction of a sense opposite to that of movement of the cutting edge portion of the cutter at the cross point so that successive portions of the edge to be chamfered engage the cross point thereby chamfering the edge at the cross point.

2. A method of chamfering an edge of a plate-like workpiece, especially a workpiece made of a silicon steel plate, comprising the steps of:

providing a rotating circular cutter having a ring-shaped cutting edge portion formed along a periphery of a holder thereof, the cutting edge portion having an edge tip defining a circle, said edge tip having a rake angle within the range of 0 to −1.0 degrees and a relief angle which has a zero or positive angle;

orienting the cutter to the workpiece so that the edge of the workpiece to be chamfered engages the edge tip at only one portion of the circle as the workpiece moves with respect to the cutter to engage various portions of the edge to be chamfered, this step of orienting including establishing positional relationships such that:

(a) the angel formed between a lower surface of the workpiece and the working plane of the cutter, which plane includes a circle defined by the edge tip of the cutting edge portion of the cutter, falls within the range of 0° to 45°, (b) the plane including the upper surface of the workpiece crosses at two points with said circle defined by the edge tip of the cutting edge portion of the cutter, (c) the working plane of the cutter is inclined relative to the edge of the workpiece to be chamfered such that the working plane crosses with the edge of the workpiece at only the front portion of the cutter working plane in a moving direction of the workpiece so as to allow the edge of the workpiece to be chamfered only at the single cross point thereby formed, and (d) rotation of the circular cutter is permitted such that, for a projection of the cutter onto the lower surface of the workpiece, the edge of the cutting edge portion of the cutter is moved at the cross point from an overlapping region between the projection of the cutter and the workpiece to a non-overlapping region thereof;

rotating the cutter; and moving the workpiece in a direction of a sense opposite to that of movement of the cutting edge portion of the cutter at the cross point so that successive portions of the edge of the workpiece to be chamfered engage the cross point thereby chamfering the edge at the cross point.

* * * * *